US008887964B2

(12) United States Patent
Jokitalo et al.

(10) Patent No.: US 8,887,964 B2
(45) Date of Patent: Nov. 18, 2014

(54) DISPENSING MECHANISM AND A DISPENSER

(71) Applicant: SCA Hygiene Products AB, Gothenburg (SE)

(72) Inventors: Joonas Jokitalo, Borlange (SE); Erik Hjort, Borlange (SE)

(73) Assignee: SCA Hygiene Products AB, Gothenburg (SE)

( * ) Notice: Subject to any disclaimer, the term of this patent is extended or adjusted under 35 U.S.C. 154(b) by 0 days.

(21) Appl. No.: 14/026,362

(22) Filed: Sep. 13, 2013

(65) Prior Publication Data

US 2014/0021223 A1 Jan. 23, 2014

Related U.S. Application Data

(63) Continuation of application No. PCT/SE2011/050275, filed on Mar. 14, 2011.

(51) Int. Cl.

| | |
|---|---|
| ***B65D 37/00*** | (2006.01) |
| ***B65D 83/00*** | (2006.01) |
| ***A47K 5/12*** | (2006.01) |
| ***B65D 35/40*** | (2006.01) |

(52) U.S. Cl.

CPC ..... *B65D 83/0055* (2013.01); *A47K 5/1208* (2013.01); *B65D 35/40* (2013.01)

USPC ..... 222/207; 222/181.3; 222/213; 222/103; 222/505

(58) Field of Classification Search

CPC .... B05B 11/3033; B05B 11/303; A47K 5/12; A47K 5/1201; A47K 5/1208; B65D 35/28; B65D 35/40

USPC ..... 222/207, 103, 181.3, 95, 214, 213, 180, 222/181.1, 181.2; 251/7, 6

See application file for complete search history.

(56) References Cited

U.S. PATENT DOCUMENTS

| | | | | |
|---|---|---|---|---|
| 2,113,022 | A * | 4/1938 | Hefti | 222/207 |
| 3,741,439 | A | 6/1973 | Vehrs | |
| 3,881,641 | A * | 5/1975 | Pliml et al. | 222/207 |
| 4,570,829 | A * | 2/1986 | Allen | 222/207 |
| 4,715,517 | A * | 12/1987 | Potter et al. | 222/181.2 |

(Continued)

FOREIGN PATENT DOCUMENTS

EP 0336953 A1 10/1989

*Primary Examiner* — Frederick C Nicolas
*Assistant Examiner* — Bob Zadeh
(74) *Attorney, Agent, or Firm* — Drinker Biddle & Reath LLP

(57) ABSTRACT

A dispensing mechanism for a liquid container includes a hollow flexible dispensing portion and a dispenser. The dispensing mechanism includes a first lever arranged to pivot about a first pivot axis and a second lever arranged to pivot about a second pivot axis and includes a user operated portion. The first lever includes a first sliding surface and the second lever includes a second sliding surface. The first and second sliding surfaces bear in sliding abutment against each other at an abutment point. The first and second pivot axes are substantially parallel to each other, and a first plane extends through the first and second pivot axes. In a non-actuated position of the dispensing mechanism, the user operated portion of the second lever and the abutment point are arranged on a first side of the first plane. The first sliding surface at least at the abutment point, is convex and the abutment point remains on the first side of the first plane over at least a first ⅔ of a dispensing stroke of the first lever.

33 Claims, 5 Drawing Sheets

(56) References Cited

U.S. PATENT DOCUMENTS 4,858,271 A * 8/1989 Berfield et al. ..... 15/339
5,042,691 A 8/1991 Maldonado
6,068,162 A 5/2000 De Winter et al.
6,540,110 B2 * 4/2003 Weiser ..... 222/103

* cited by examiner

DISPENSING MECHANISM AND A DISPENSER

CROSS-REFERENCE TO PRIOR APPLICATION

This application is a Continuation Application of International Application No. PCT/SE2011/050275 filed Mar. 14, 2011, which is incorporated herein in its entirety.

TECHNICAL FIELD

The present disclosure relates to a dispensing mechanism for a liquid container arranged in liquid communication with a hollow flexible dispensing portion, and a dispenser including such a dispensing mechanism.

BACKGROUND

Dispensing apparatuses for liquids in which the apparatus includes a container for the liquid and is provided with, or connected to, a flexible dispensing part are commonly used for dispensing such diverse liquids as for instance liquid soap, foam soap, alcogel, disinfecting or anti bacterial liquid, and lotion. The flexible dispensing part is filled with the relevant liquid and subjected to an external force in order to dispense the liquid therefrom. A user may apply a force on the flexible dispensing part directly or indirectly. The flexible dispensing part may be of such a size that a suitable or desired volume, e.g. 1 milliliter, of the liquid is dispensed upon complete actuation of the flexible dispensing part.

U.S. Pat. No. 3,741,439 discloses a viscous liquid dispenser suitable for dispensing contents of collapsible tubes. An elastic tubing portion is connected to the collapsible tube and affected by a dispensing mechanism including two levers, a dispensing lever and a movable lever, in order to dispense liquid from the elastic tubing portion. The dispensing lever has two arms, a lower arm and an upper arm, each one on a respective side of a fulcrum. The movable lever has its fulcrum at one end thereof. The upper arm of the dispensing lever bears against a shim on the movable lever such that, during a dispensing stroke of the dispensing lever, the upper arm moves along the shim towards the fulcrum of the movable lever. The lower arm of the dispensing lever is subjected to a force by a user to perform a dispensing stroke when viscous liquid is to be dispensed. During the dispensing stroke, the dispensing lever rotates about its fulcrum and the upper arm presses against the shim of the movable lever. Since the lower arm of the dispensing lever is longer than the upper arm, a force increasing leverage is achieved between the force applied by the user and a force by means of which the upper arm presses against the shim of the movable lever. However, during the dispensing stroke, the upper arm moves along the shim of the movable lever and a leverage of the movable lever decrease from a maximum value at the beginning of the dispensing stroke. Accordingly, a user must apply an increasing force as the dispensing stroke progresses to achieve the full dispensing stroke.

U.S. Pat. No. 6,540,110 discloses an apparatus for dispensing a free-flowing product in a bag. By means of a squeezing device a user may dispense a portion of the free-flowing product from an apportioning chamber of the bag. The squeezing device includes an abutment wall, against which the apportionment chamber abuts, and hand-actuated pressure-exerting parts, including a hand lever and a pressure-exerting pivoting part. The pressure-exerting pivot part clamps the bag in the region of the apportioning chamber and squeezes free flowing product therefrom upon a user actuating the hand lever. The leverage between the hand lever and the pressure-exerting pivot part appears to be substantially fixed over the dispensing stroke of the hand lever.

A complete actuation of a flexible dispensing part for dispensing liquid may be difficult to achieve. Some dispensing mechanisms require a user to apply an increasing force to achieve such complete actuation. Thus, it may be difficult to dispense a desired volume of liquid.

SUMMARY

It is desired to provide a dispensing mechanism which will allow a user to easily dispense a liquid from a flexible dispensing portion of a liquid container or a flexible dispensing portion of a dispenser.

According to an aspect, a dispensing mechanism for a liquid container is arranged in liquid communication with a hollow flexible dispensing portion. The dispensing mechanism includes:

- a fixed dolly adapted to abut against the hollow flexible dispensing portion,
- a first lever arranged to pivot about a first pivot axis and including a contact surface adapted to abut against the flexible dispensing portion such that the hollow flexible dispensing portion is able to be arranged between the contact surface and the dolly, and
- a second lever arranged to pivot about a second pivot axis and including a user operated portion.

The first lever includes a first sliding surface and the second lever includes a second sliding surface. The first and second sliding surfaces bear in sliding abutment against each other at an abutment point. The first and second pivot axes are substantially parallel to each other, and a first plane extends through the first and second pivot axes. The first pivot axis, the second pivot axis and the abutment point form corners of a triangle in a second plane substantially perpendicular to the first and second pivot axes. In a non-actuated position of the dispensing mechanism, the user operated portion of the second lever and the abutment point are arranged on a first side of the first plane. The first sliding surface, at least at the abutment point, is convex and the abutment point remains on the first side of the first plane over at least a first ⅔ of a dispensing stroke of the first lever.

Due to the particular arrangement of the first and second pivot axes and the abutment point, the convex first sliding surface and the second sliding surface, and the abutment point being arranged on the first side of the first plane over the first ⅔ of the dispensing stroke of the first lever, a leverage ratio between the abutment point and the second pivot axis on the one hand and the user operated portion and the second pivot axis on the other hand will increase over a substantial part of the dispensing stroke. Accordingly, a user force applied to the second lever suitably at the user operated portion, which user force is required in order to subject the first lever to a dispensing stroke, will decrease from a first initial level over at least a substantial part of the first ⅔ of the dispensing stroke of the first lever. This applies to the dispensing mechanism as such. In practice, the hollow flexible dispensing portion arranged between the dolly and the contact surface of the first lever affects the user force. Naturally, the increasing leverage ratio has a positive effect also in practice. Expressed differently, a constant user force applied to the user operated portion will result in an increased force being applied to the hollow flexible dispensing portion from the contact surface of the first lever as the dispensing stroke progresses over at least the first ⅔ of the dispensing stroke. As a result, the dispensing mechanism allows a user to easily dispense a liquid from an outlet mechanism of a liquid container or an outlet mechanism of a dispensing apparatus.

In an area of the first sliding surface, a portion of the first lever may have many different shapes including, circular, oval, a convex section broken by a concave section etc, as long as the first sliding surface is convex, at least at the abutment point. Accordingly, in the above mentioned area of the first sliding surface there may be two or more separate first sliding surfaces on the first lever, one at a time being in abutment with the second sliding surface as the dispensing stroke progresses.

The liquid container may be adapted to be filled with a liquid such as for instance liquid soap, foam soap, alcogel, disinfecting or anti bacterial liquid, or lotion. The flexible dispensing portion may be filled with the relevant liquid and subjected to an external force in order to dispense the liquid therefrom. The flexible dispensing portion may be of such a size that a suitable or desired volume, e.g. 1 milliliter, of the liquid may be dispensed upon performing a full dispensing stroke. Since the first and second sliding surfaces bear in sliding abutment against each other, the abutment point moves along the sliding surfaces as a dispensing stroke progresses.

According to embodiments, the first sliding surface is convex, at least at the abutment point, and may have a radius extending from a centre point, the centre point remaining on the first side of the first plane over at least half of the dispensing stroke of the first lever. In this manner, the leverage ratio between the abutment point and the second pivot axis on the one hand and the user operated portion and the second pivot axis on the other hand will increase over a substantial part of the dispensing stroke. Accordingly, a user force applied to the second lever, which is required in order to subject the first lever to a dispensing stroke, will decrease from a first initial level over at least the half of the dispensing stroke of the first lever. Again, this applies to the dispensing mechanism as such. The centre point may shift as the dispensing stroke progresses depending on the shape of the first sliding surface, but the leverage ratio will increase as long as a present centre point remains on the first side of the first plane.

Seen from a mechanics perspective, the leverage ratio will increase during a dispensing stroke until the centre point passes from the first side of the first plane to a second side of the first plane. In comparison between embodiments referring to the abutment point remaining on a first side of the first plane on the one hand, and the centre point remaining on a first side of the first plane on the other hand, it may be noted that it may become complex to determine a true centre point. Thus, the abutment point may be a suitable approximation for the centre point.

According to embodiments, the first pivot axis may be arranged at a first end of the first lever, and the first sliding surface and the contact surface may be arranged closer to a second end of the first lever than to the first pivot axis. The second pivot axis may be arranged at a first end of the second lever, and the second sliding surface and the user operated portion may be arranged closer to a second end of the second lever than the second pivot axis is. In this manner, the first and second sliding surfaces may be arranged such that the abutment point travels along the first and second sliding surfaces during the dispensing stroke in an area between the first pivot axis and the user operated portion on one side of the abutment point and the second pivot axis on a second side of the abutment point.

According to embodiments, the abutment point may remain on the first side of the first plane over the entire dispensing stroke. In this manner, a user force applied to the second lever, which is required in order to subject the first lever to a dispensing stroke, may decrease from a first initial level over at least a substantial part of the dispensing stroke of the first lever. Again, this applies to the dispensing mechanism as such.

According to embodiments, the centre point may remain on the first side of the first plane over the entire dispensing stroke. In this manner, a user force applied to the second lever, which is required in order to subject the first lever to a dispensing stroke, may decrease from a first initial level over the entire dispensing stroke of the first lever. Again, this applies to the dispensing mechanism as such.

According to embodiments, the contact surface of the first lever may be adapted to apply a first force to the hollow flexible dispensing portion upon a user pressing against the user operated portion of the second lever with a second force. The first and second forces each may include at least one component directed perpendicularly towards the first plane.

According to embodiments, the second sliding surface may be substantially flat.

According to embodiments, the first sliding surface may have a radius of between 2-30 mm.

According to embodiments, the contact surface may include a portion of a convex cylindrical surface having a radius of between 2-500 mm. Alternatively, the contact surface may be substantially flat.

According to embodiments, the dolly may be adapted to abut against the hollow flexible dispensing portion only over less than half of a circumference of the hollow flexible dispensing portion in its area adapted to abut the dolly. In this manner, collapsing the hollow flexible portion to dispense the liquid may require a lesser force than if the dolly would abut against a larger portion of the hollow flexible portion.

According to embodiments, the first lever may includes two first sliding surfaces arranged side by side and in parallel with each other.

According to embodiments, the contact surface may be arranged between the two first sliding surfaces. In this manner, the first lever may be subjected to a symmetrical load as the contact surface is pressed against he flexible dispensing portion.

It is further desired to provide a dispenser with a dispensing mechanism which will allow a user to easily dispense a liquid from a flexible dispensing portion of a liquid container or a flexible dispensing portion of the dispenser.

According to a further aspect, a dispenser for a liquid includes a dispensing mechanism according to any of the aspects and embodiments discussed above.

According to embodiments, the dispenser may be adapted for wall-mounting.

According to embodiments, the dispenser may include a seat for receiving a disposable liquid container.

According to embodiments, the dispenser may include a liquid container adapted to be refilled with a liquid. Alternatively, the liquid container may be disposable.

According to embodiments, the dispenser may include a hollow flexible dispensing portion. According to these embodiments, the liquid container may be connected to the hollow flexible portion. The liquid container may be disposable or refillable.

According to embodiments, a disposable liquid container may include the hollow flexible portion.

According to embodiments, the dispensing mechanism may be arranged at a lower end of the dispenser.

Further features of, and advantages with, the present invention will become apparent when studying the appended claims and the following detailed description. Those skilled in the art will realize that different features of the present invention may be combined to create embodiments other than those described in the following, without departing from the scope of the present invention, as defined by the appended claims.

BRIEF DESCRIPTION OF THE DRAWINGS

The various aspects of embodiments of the invention, including particular features and advantages, will be readily understood from the following detailed description and the accompanying drawings, in which.

DETAILED DESCRIPTION

The present invention will now be described more fully with reference to the accompanying drawings, in which example embodiments are shown. However, this invention should not be construed as limited to the embodiments set forth herein. Disclosed features of example embodiments may be combined as readily understood by one of ordinary skill in the art to which this invention belongs. Like numbers refer to like elements throughout.

Well-known functions or constructions will not necessarily be described in detail for brevity and/or clarity.

Figure 1:
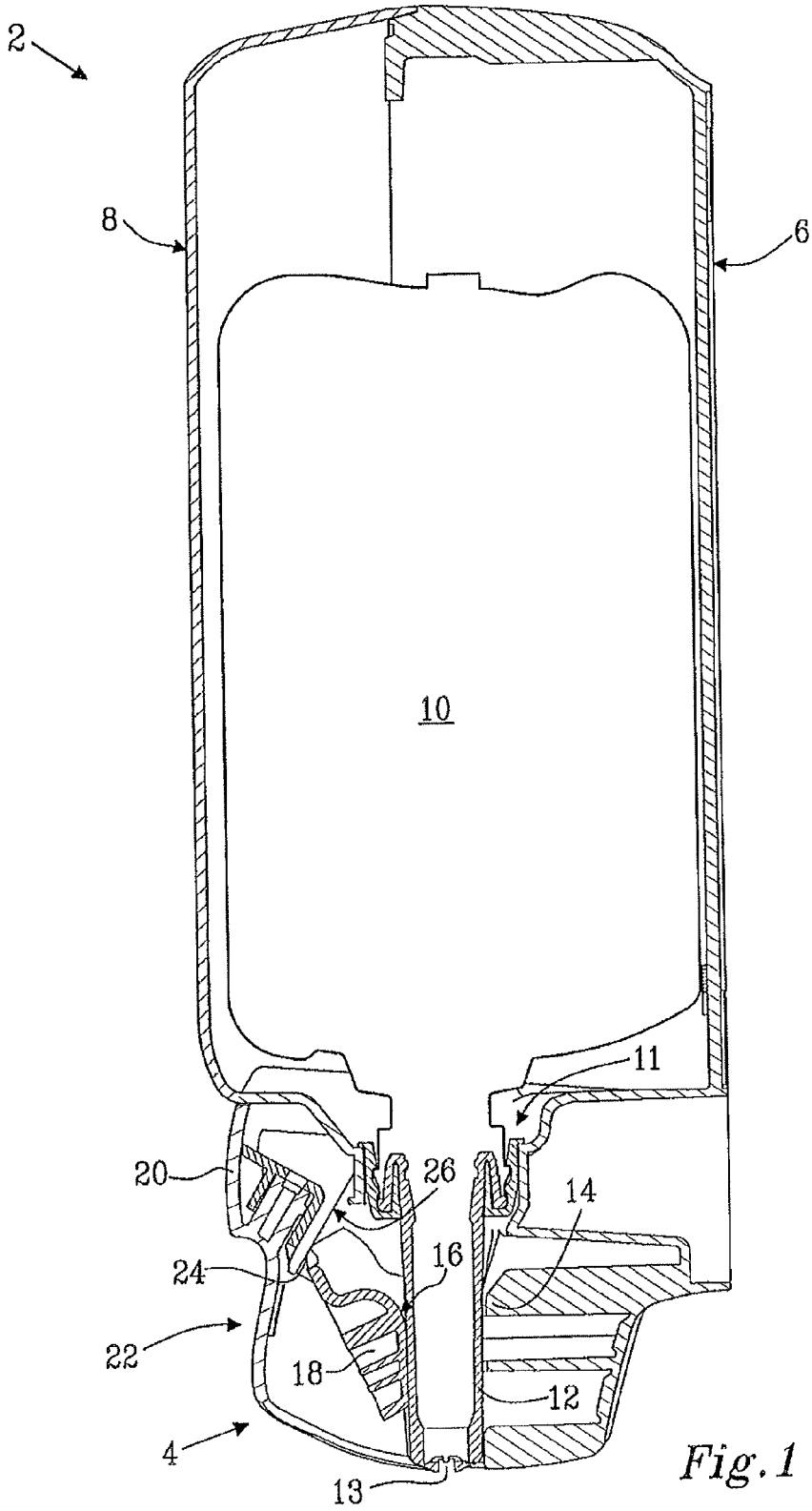
FIG. 1 illustrates a cross section through a dispenser for liquid according to example embodiments.

FIG. 1 illustrates a cross section through a dispenser 2 for liquid according to example embodiments. The dispenser 2 includes a dispensing mechanism 4. The dispenser 2 includes a wall mountable portion 6 and a lid 8. Inside the dispenser 2 a liquid container 10 for a liquid such as liquid soap is arranged. There is provided a seat 11 for the container 10 in the dispenser. The lid 8 may be opened in order to replace or refill the liquid container 10. Accordingly, the container 10 may either be disposable or refillable. A hollow flexible dispensing portion 12 is arranged at a lower end of the dispenser 2 and is arranged in liquid communication with an inside of the liquid container 10. The flexible portion 12 is provided with an opening 13 and may form part of the dispenser 2 itself or of the liquid container 10.

The flexible portion 12 is arranged between a fixed dolly 14 and a contact surface 16 of a first lever 18 of the dispensing mechanism 4. The first lever 18 is arranged to pivot about a first pivot axis. Accordingly, when the first lever 18 is pivoted in a direction towards the dolly 14, the flexible portion 12 is squeezed between the contact surface 16 and the dolly 14. A valve may be arranged in the flexible portion 12 close to the opening 13 to prevent liquid from dripping out of the liquid container 10 when the flexible portion 10 is not squeezed. Similarly, a valve may be arranged between the flexible portion 12 and the liquid container 10 in order to prevent liquid from being pressed back into the container 10 when the flexible portion 12 is being squeezed. Such valves are known in the art. The dispensing mechanism 4 further includes a second lever 20 arranged to pivot about a second pivot axis and including a user operated portion 22. The user operated portion 22 is typically arranged at one end of the second lever 20 and may be as simple as a surface for a user to press against. The first lever 18 includes a first sliding surface 24, which is convex. The second lever 20 includes a second sliding surface 26. The first and second sliding surfaces 24, 26 bear in sliding abutment against each other at an abutment point.

Figure 2A:
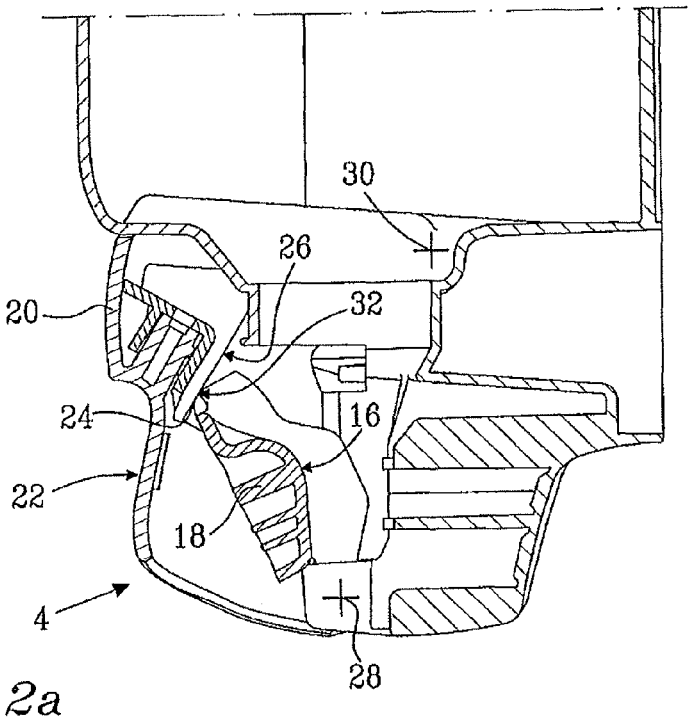
FIGS. 2*a* and 2*b* illustrate a dispensing mechanism according to example embodiments.
Figure 2B:
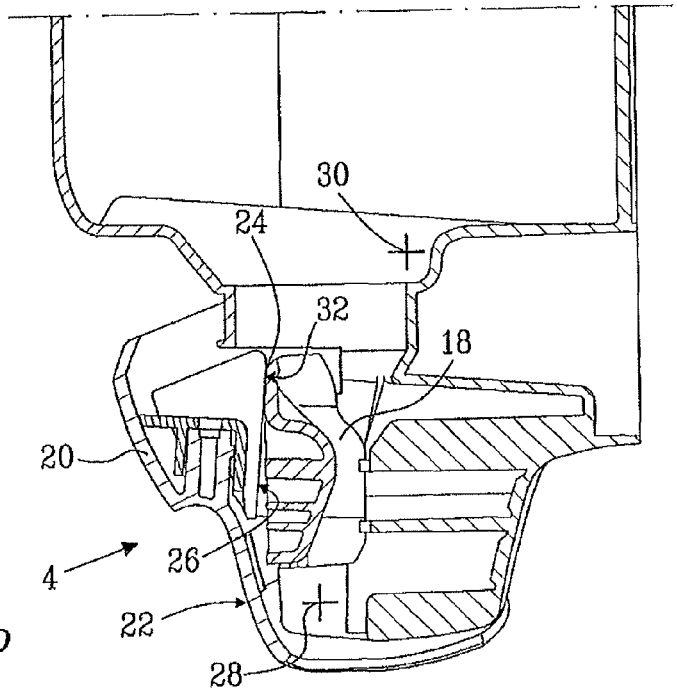

FIGS. 2*a* and 2*b* illustrate a dispensing mechanism 4 according to example embodiments. FIG. 2*a* illustrates the dispensing mechanism 4 in a non-actuated position and FIG. 2*b* illustrates the dispensing mechanism 4 in a substantially fully actuated position. A hollow flexible dispensing portion of a dispenser associated with the dispensing mechanism 4 has been omitted in FIGS. 2*a* and 2*b* for clarity reasons.

A first lever 18 pivots about a first pivot axis 28. The first lever 18 includes a contact surface 16 adapted to abut against the non-shown hollow flexible dispensing portion. A second lever 20 pivots about a second pivot axis 30. The second lever 20 is adapted to be operated by a user in order to dispense a liquid from the dispenser associated with the dispensing mechanism 4. The second lever 20 is provided with a user operated portion 22 for this purpose.

The first lever 18 includes a first sliding surface 24, which is convex. The second lever 20 includes a second sliding surface 26, which is substantially flat. The first and second sliding surfaces 24, 26 bear in sliding abutment against each other at an abutment point 32. The first lever 18 performs a dispensing stroke as a user presses against the user operated portion 22 of the second lever 20, starting from a non-actuated position of the dispensing mechanism 4 (FIG. 2*a*) and ending at a fully actuated position (FIG. 2*b*). Accordingly, the abutment point 32 travels along the first and second sliding surfaces 24, 26 as a dispensing stroke progresses.

The first pivot axis 28 is arranged at a first end of the first lever 18. The first sliding surface 24 and the contact surface 16 are arranged closer to a second end of the first lever 18 than to the first pivot axis 28. The second pivot axis 30 is arranged at a first end of the second lever 20. The second sliding surface 26 and the user operated portion 22 are arranged closer to a second end of the second lever 20 than the second pivot axis 30 is, i.e. seen in a direction from the first end of the second lever 20, the second pivot axis 30, the second sliding surface 26, and the user operated portion 22 are arranged in that order.

As will be explained below, a constant force applied to the user operated portion 22 will lead to an increasing force being applied to the non-shown hollow flexible dispensing portion by the first lever 18 as the dispensing stroke progresses.

Figure 3:
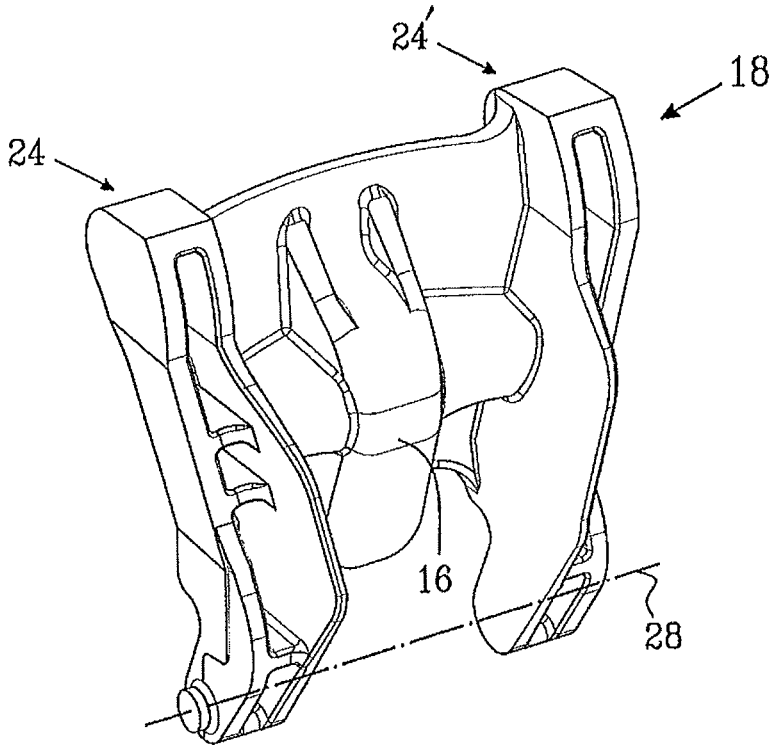
FIG. 3 illustrates a first lever of a dispensing mechanism according to example embodiments.

FIG. 3 illustrates a first lever 18 of a dispensing mechanism according to example embodiments. The first lever 18 is adapted to pivot about a first pivot axis 28. The first lever 18 includes two first sliding surfaces 24, 24' arranged side by side and in parallel with each other. The first sliding surfaces 24, 24' are adapted to abut against one or two second sliding surfaces of a second lever. A contact surface 16 adapted to abut against a hollow flexible dispensing portion of a dispenser is arranged between the two first sliding surfaces 24, 24'. The contact surface 16 may be convex, for instance including a portion of a cylindrical surface having a radius of between 2-500 mm.

Figure 4:
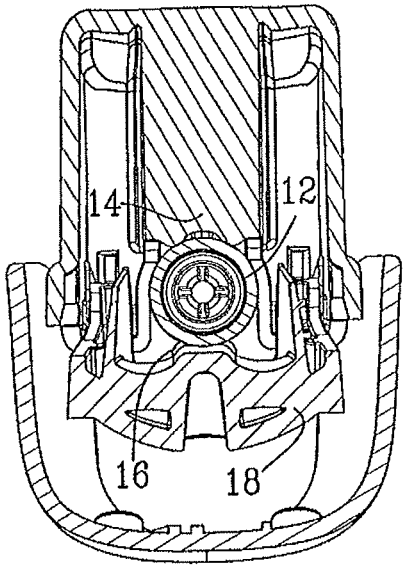
FIG. 4 illustrates a cross section through a dispensing mechanism according to example embodiments.

FIG. 4 illustrates a cross section through a dispensing mechanism 4 according to example embodiments. A hollow flexible dispensing portion 12 is arranged between a contact surface 16 of a first lever 18 and a dolly 14. The dolly 14 abuts against the flexible dispensing portion 12 only over less than half of a circumference of the flexible dispensing portion 12.

Figure 5:
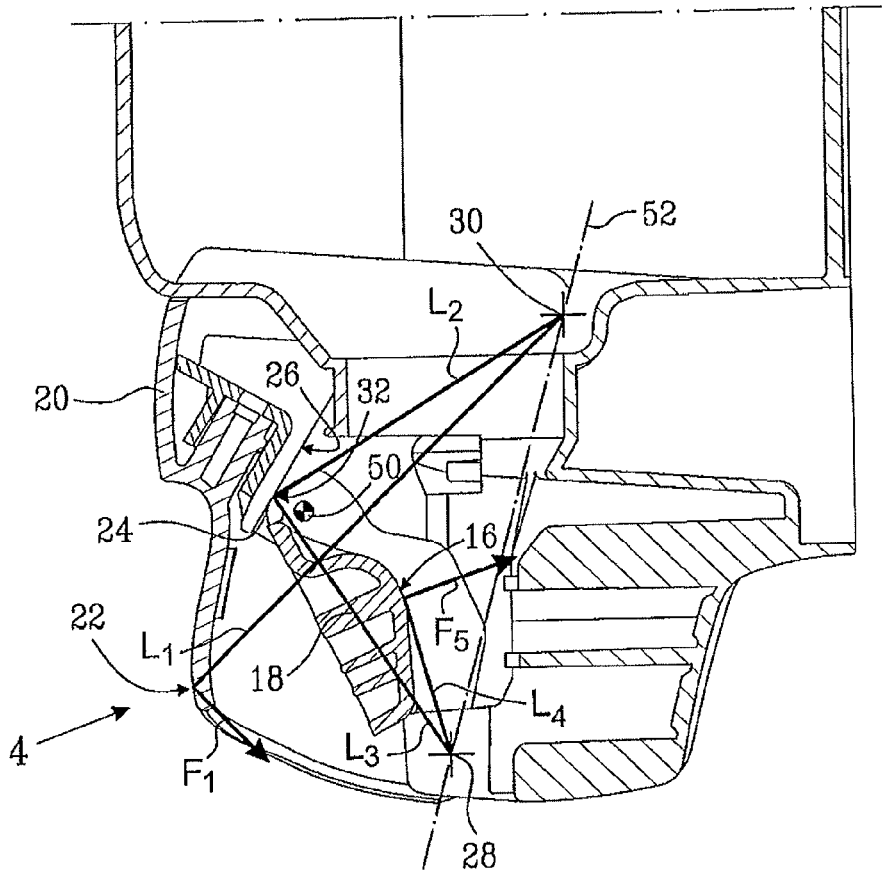
FIG. 5 illustrates a dispensing mechanism according to example embodiments.

FIG. 5 illustrates a dispensing mechanism 4 according to example embodiments. Again, a first lever 18 pivots about a first pivot axis 28. The first lever 18 includes a contact surface 16 adapted to abut against a non-shown hollow flexible dispensing portion. A second lever 20 pivots about a second pivot axis 30. The second lever 20 is adapted to be operated by a user in order to dispense a liquid from a dispenser associated with the dispensing mechanism 4. The second lever 20 is provided with a user operated portion 22 for this purpose. The first lever 18 includes a first sliding surface 24, which is convex and has a radius with a centre point 50. The radius may for instance be 2-30 mm. The second lever 20 includes a second sliding surface 26, which is substantially flat. The first and second sliding surfaces 24, 26 bear in sliding abutment against each other at an abutment point 32. As a user presses against the user operated portion 22 of the second lever 20, the first lever 18 performs a dispensing stroke. The abutment point 32 passes along the first and second sliding surfaces 24, 26 as the dispensing stroke progresses.

The first and second pivot axes 28, 30 are substantially parallel to each other, and a first plane 52 extends through the first and second pivot axes 28, 30. The first pivot axis 28, the second pivot axis 30, and the abutment point 32 form corners of a triangle in a second plane substantially perpendicular to the first and second pivot axes 28, 30. In the illustrated non-actuated position of the dispensing mechanism 4, the user operated portion 22 of the second lever 20, the centre point 50, and the abutment point 32 are arranged on a first side of the first plane 52.

In FIG. 5 a first length L1 and a second length L2 are indicated. The first length L1 extends between the second pivot axis 30 and the user operated portion 22. The second length L2 extends from the second pivot axis 30 to the abutment point 32. A leverage ratio is formed between the first length L1 and the second length L2. The first length L1 is constant over an entire dispensing stroke. The second length L2 however, decreases as the dispensing stroke progresses because the abutment point 32 moves closer to the second pivot axis 30 as the dispensing stroke progresses. Accordingly, the leverage ratio will increase over a dispensing stroke and a constant user force F1 applied to the user operated portion 22 entails that an applied force F5 onto the non-shown hollow flexible dispensing portion increases over the dispensing stroke.

Seen from a mechanics perspective, the leverage ratio will increase during a dispensing stroke as long as the centre point 50 remains on the first side of the first plane 52. If the dispensing stroke reaches an end with the centre point 50 remaining on the first side of the first plane 52 (compare FIG. 2*b*), this means that the leverage ratio will increase over the entire dispensing stroke.

Purely provided as an example, the embodiments illustrated in FIG. 5 may have a distance between the first and second pivot axes 28, 30 of about 63 mm, and a first length L1 of about 73 mm. The second length L2 decreases over the dispensing stroke from an initial length of about 48 mm to a length of about 32 mm at the end of the dispensing stroke. The first lever 18 is associated with a third length L3 extending between the first pivot axis 28 and the abutment point 32 and a fourth length L4 extending between the first pivot axis 28 and the contact surface 16. The third length L3 decreases over the dispensing stroke from an initial length of about 44 mm to a length of about 41 mm at the end of the dispensing stroke. The fourth length L4 is 23 mm. Such an arrangement results in a user force F1 of 20 Newton being applied to the user portion 22 over the entire dispensing stroke for the applied force F5 to increase from 22 Newton at the beginning of the dispensing stroke to 50 Newton at the end of the dispensing stroke. For a full dispensing stroke of the first lever 18, the second lever 20 travels about 34 mm at the user operated portion. It may be noted that the decrease of the third length L3 over the dispensing stroke results in a decreasing leverage ratio between the third and fourth lengths L3, L4 over the dispensing stroke. However, this decrease is minor in comparison with the leverage ratio increase of the first and second lengths L1, L2.

Any dispensing mechanism should, from a practical perspective, be designed to operate with a user force of a level that a user in practice may apply to a user portion 22 of the second lever 20. Due to the increasing leverage ratio in dispensing mechanisms according to embodiments, the user force required for pressing the second lever 20 may remain within practicable user force levers, also when the non-shown hollow flexible dispensing portion affects the user force. The leverage ratio may not be required to increase over the entire dispensing stroke. After for instance about half a dispensing stroke, the leverage ratio may be allowed to decrease again and, accordingly, the dispensing mechanisms may alternatively be designed such that the centre point 50 passes from the first side of the first plane 52 to a second side of the first plane 52 after about half a dispensing stroke. In such a case the dispensing mechanism may suitably be designed such that a user force at an end of a dispensing stroke is not substantially above a level at a beginning of the dispensing stroke.

According to example embodiments, in an area of the first sliding surface 24, a portion of the first lever 18 may have many different shapes including, partially circular, partially oval, a convex section broken by a concave section etc.—as long as the first sliding surface 24 is convex, at least at the abutment point 32, and bearing in mind that the abutment point 32 passes along the first sliding surface 24 as a dispensing stroke progresses. Accordingly, in the above mentioned area of the first sliding surface 24 there may be two or more sliding surfaces on the first lever 18, one at a time being in abutment with a second sliding surface 26 as the dispensing stroke progresses. For some shapes of the convex first sliding surface 24, the centre point 50 may shift as the dispensing stroke progresses. Still, the leverage ratio will increase as long as a present centre point 50 remains on the first side of the first plane 52.

Figure 6A:
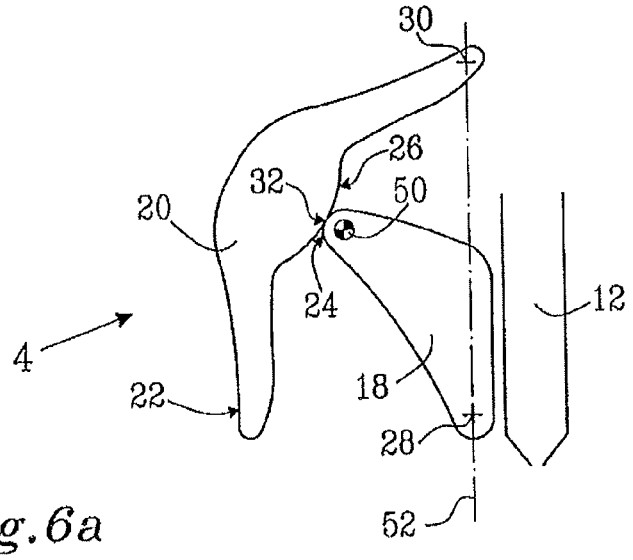
FIGS. 6*a*-6*c* illustrate schematically example embodiments of dispensing mechanisms.
Figure 6B:
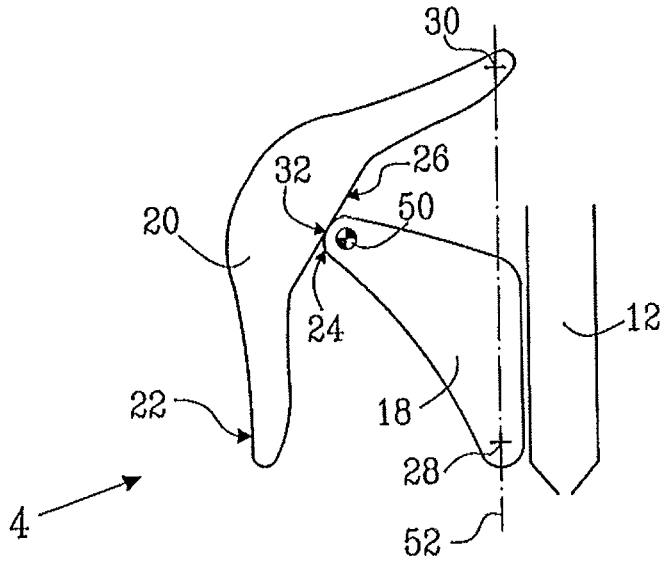
Figure 6C:
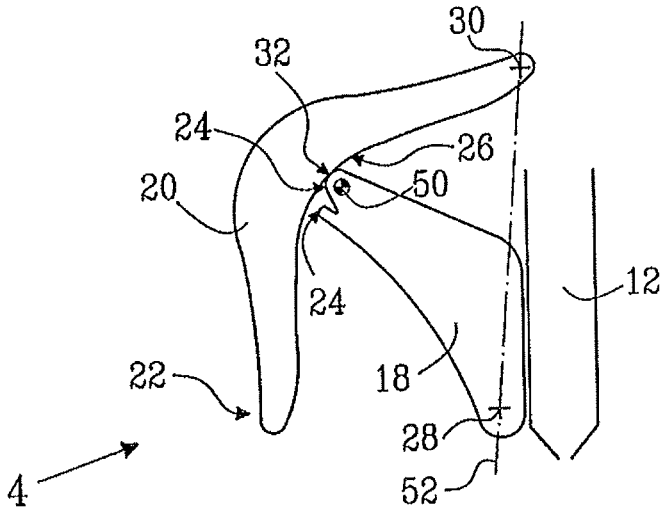

FIGS. 6*a*-6*c* illustrate schematically example embodiments of dispensing mechanisms 4, wherein the above-mentioned leverage ratio increases over at least half a dispensing stroke of a first lever 18 due to a centre point 50 remaining on a first side of the first plane 52 over at least half the dispensing stroke. In FIGS. 6*a*-6*c* the first lever 18, a first pivot axis 28, a convex first sliding surface 24, a second lever 20, a user operated portion 22, a second pivot axis 30, a second sliding surface 26, an abutment point 32, the first plane 52, the centre point 50, and a hollow flexible dispensing portion 12 have been indicated. FIGS. 6*b* and 6*c* illustrate embodiments where the centre point 50 shifts as the abutment point 32 moves during the dispensing stroke. FIG. 6*a* embodiments includes a convex second sliding surface 26. FIG. 6*b* embodiments include a first sliding surface 24 including an oval portion. FIG. 6*c* embodiments include a concave second sliding surface 26 and two first sliding surfaces 24, one at a time being in abutment with the second sliding surface 26 as the dispensing stroke progresses.

Example embodiments described above may be combined as understood by a person skilled in the art and many different alterations, modifications and the like will become apparent for those skilled in the art.

Therefore, it is to be understood that the foregoing is illustrative of various example embodiments and the invention is not to be limited to the specific embodiments disclosed and that modifications to the disclosed embodiments, combinations of features of disclosed embodiments as well as other embodiments are intended to be included within the scope of the appended claims.

As used herein, the term "comprising" or "comprises" is open-ended, and includes one or more stated features, elements, steps, components or functions but does not preclude the presence or addition of one or more other features, elements, steps, components, functions or groups thereof.

As used herein, the term "and/or" includes any and all combinations of one or more of the associated listed items.

As used herein, the common abbreviation "e.g.", which derives from the Latin phrase "exempli gratia," may be used to introduce or specify a general example or examples of a previously mentioned item, and is not intended to be limiting of such item. If used herein, the common abbreviation "i.e.", which derives from the Latin phrase "id est," may be used to specify a particular item from a more general recitation.

The terminology used herein is for the purpose of describing particular embodiments only and is not intended to be limiting. As used herein, the singular forms "a", "an" and "the" are intended to include the plural forms as well, unless the context clearly indicates otherwise.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It will be understood that when an element is referred to as being "on", "coupled" or "connected" to another element, it can be directly on, coupled or connected to the other element or intervening elements may also be present. In contrast, when an element is referred to as being "directly on", "directly coupled" or "directly connected" to another element, there are no intervening elements present.

It will be understood that although the terms first, second, third etc. may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section discussed herein could be termed a second element, component, region, layer or section without departing from the teachings of the present invention.

Spatially relative terms, such as "beneath", "below", "bottom", "lower", "above", "top", "upper" and the like, may be used herein for ease of description to describe one element's or feature's relationship to other element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly. Also, as used herein, "lateral" refers to a direction that is substantially orthogonal to a vertical direction.

Example embodiments of the present invention have been described herein with reference to cross-section illustrations that are schematic illustrations of idealized embodiments (and intermediate structures) of the invention. As such, variations from the shapes of the illustrations as a result, for example, of manufacturing techniques and/or tolerances are to be expected. Thus, embodiments of the present invention should not be construed as limited to the particular shapes of regions illustrated herein but are to include deviations in shape that result, for example, from manufacturing.

The invention claimed is:

1. A dispensing mechanism for a liquid container arranged in liquid communication with a hollow flexible dispensing portion, the dispensing mechanism comprising:

a fixed dolly adapted to abut against the hollow flexible dispensing portion, a first lever arranged to pivot about a first pivot axis, wherein the first pivot axis is fixed relative to the fixed dolly during a dispensing stroke of the first lever, and comprising a contact surface adapted to abut against the flexible dispensing portion such that the hollow flexible dispensing portion is able to be arranged between the contact surface and the fixed dolly, and a second lever arranged to pivot about a second pivot axis and comprising a user operated portion, wherein the first lever comprises a first sliding surface and the second lever comprises a second sliding surface, the first and second sliding surfaces bearing in sliding abutment against each other at an abutment point, wherein the first and second pivot axes are substantially parallel to each other, and a first plane extends through the first and second pivot axes, the first pivot axis, the second pivot axis and the abutment point forming corners of a triangle in a second plane substantially perpendicular to the first and second pivot axes, wherein, in a non-actuated position of the dispensing mechanism, the user operated portion of the second lever and the abutment point are arranged on a first side of the first plane, and wherein the first sliding surface, at least at the abutment point, is convex and the abutment point remains on the first side of the first plane over at least a first ⅔ of the dispensing stroke of the first lever.

2. The dispensing mechanism according to claim 1, wherein the first sliding surface is convex, at least at the abutment point, with a radius extending from a centre point, the centre point remaining on the first side of the first plane over at least half of the dispensing stroke of the first lever.

3. The dispensing mechanism according to claim 1, wherein the first pivot axis is arranged at a first end of the first lever, and the first sliding surface and the contact surface are arranged closer to a second end of the first lever than to the first pivot axis, and wherein the second pivot axis is arranged at a first end of the second lever, and the second sliding surface and the user operated portion are arranged closer to a second end of the second lever than the second pivot axis is.

4. The dispensing mechanism according to claim 1, wherein the abutment point remains on the first side of the first plane over the entire dispensing stroke.

5. The dispensing mechanism according to claim 2, wherein the centre point remains on the first side of the first plane over the entire dispensing stroke.

6. The dispensing mechanism according to claim 1, wherein the contact surface of the first lever is adapted to apply a first force to the hollow flexible dispensing portion upon a user pressing against the user operated portion of the second lever with a second force, and wherein the first and second forces each comprise at least one component directed perpendicularly towards the first plane.

7. The dispensing mechanism according to claim 1, wherein the second sliding surface is substantially flat.

8. The dispensing mechanism according to claim 1, wherein the first sliding surface has a radius of between 2-30 mm.

9. The dispensing mechanism according to claim 1, wherein the contact surface comprises a portion of a convex cylindrical surface having a radius of between 2-500 mm.

10. The dispensing mechanism according to claim 1, wherein the fixed dolly is adapted to abut against the hollow flexible dispensing portion only over less than half of a circumference of the hollow flexible dispensing portion of an area adapted to abut the fixed dolly.

11. The dispensing mechanism according to claim 1, wherein the first lever comprises two first sliding surfaces arranged side by side and in parallel with each other.

12. The dispensing mechanism according to claim 11, wherein the contact surface is arranged between the two first sliding surfaces.

13. A dispenser for a liquid comprising the dispensing mechanism according to claim 1.

14. The dispenser according to claim 13, wherein the dispenser comprises a seat for receiving a disposable liquid container.

15. The dispenser according to claim 13, wherein the dispenser comprises a liquid container adapted to be refilled with a liquid.

16. The dispenser according to claim 13, wherein the dispenser comprises the hollow flexible dispensing portion.

17. The dispenser according to claim 13, wherein the dispensing mechanism is arranged at a lower end of the dispenser.

18. A dispensing mechanism for a liquid container arranged in liquid communication with a hollow flexible dispensing portion, the dispensing mechanism comprising:

a fixed dolly adapted to abut against the hollow flexible dispensing portion, a first lever arranged to pivot about a first pivot axis and comprising a contact surface adapted to abut against the flexible dispensing portion such that the hollow flexible dispensing portion is able to be arranged between the contact surface and the fixed dolly, and a second lever arranged to pivot about a second pivot axis and comprising a user operated portion, wherein the first lever comprises a first sliding surface and the second lever comprises a second sliding surface, the first and second sliding surfaces bearing in sliding abutment against each other at an abutment point, wherein the first and second pivot axes are substantially parallel to each other, and a first plane extends through the first and second pivot axes, the first pivot axis, the second pivot axis and the abutment point forming corners of a triangle in a second plane substantially perpendicular to the first and second pivot axes, wherein, in a non-actuated position of the dispensing mechanism, the user operated portion of the second lever and the abutment point are arranged on a first side of the first plane, wherein the first sliding surface, at least at the abutment point, is convex and the abutment point remains on the first side of the first plane over at least a first ⅔ of a dispensing stroke of the first lever, and wherein the first pivot axis is arranged at a first end of the first lever, and the first sliding surface and the contact surface are arranged closer to a second end of the first lever than to the first pivot axis, and wherein the second pivot axis is arranged at a first end of the second lever, and the second sliding surface and the user operated portion are arranged closer to a second end of the second lever than the second pivot axis is.

19. The dispensing mechanism according to claim 18, wherein the first sliding surface is convex, at least at the abutment point, with a radius extending from a centre point, the centre point remaining on the first side of the first plane over at least half of the dispensing stroke of the first lever.

20. The dispensing mechanism according to claim 18, wherein the abutment point remains on the first side of the first plane over the entire dispensing stroke.

21. The dispensing mechanism according to claim 19, wherein the centre point remains on the first side of the first plane over the entire dispensing stroke.

22. The dispensing mechanism according to claim 18, wherein the contact surface of the first lever is adapted to apply a first force to the hollow flexible dispensing portion upon a user pressing against the user operated portion of the second lever with a second force, and wherein the first and second forces each comprise at least one component directed perpendicularly towards the first plane.

23. The dispensing mechanism according to claim 18, wherein the second sliding surface is substantially flat.

24. The dispensing mechanism according to claim 18, wherein the first sliding surface has a radius of between 2-30 mm.

25. The dispensing mechanism according to claim 18, wherein the contact surface comprises a portion of a convex cylindrical surface having a radius of between 2-500 mm.

26. The dispensing mechanism according to claim 18, wherein the fixed dolly is adapted to abut against the hollow flexible dispensing portion only over less than half of a circumference of the hollow flexible dispensing portion of an area adapted to abut the fixed dolly.

27. The dispensing mechanism according to claim 18, wherein the first lever comprises two first sliding surfaces arranged side by side and in parallel with each other.

28. The dispensing mechanism according to claim 27, wherein the contact surface is arranged between the two first sliding surfaces.

29. A dispenser for a liquid comprising the dispensing mechanism according to claim 18.

30. The dispenser according to claim 29, wherein the dispenser comprises a seat for receiving a disposable liquid container.

31. The dispenser according to claim 29, wherein the dispenser comprises a liquid container adapted to be refilled with a liquid.

32. The dispenser according to claim 29, wherein the dispenser comprises the hollow flexible dispensing portion.

33. The dispenser according to claim 29, wherein the dispensing mechanism is arranged at a lower end of the dispenser.

* * * * *